United States Patent [19]

Sukornick et al.

[11] 4,107,055

[45] Aug. 15, 1978

[54] FABRIC COATING COMPOSITIONS, METHOD AND COATED FABRIC HAVING DRY SOIL RESIST FINISHES

[75] Inventors: Bernard Sukornick, Williamsville, N.Y.; Pritam Singh Minhas, Mendham, N.J.; Richard Francis Sweeney, Elma, N.Y.

[73] Assignee: Allied Chemical Corporation, Morris Township, Morris County, N.J.

[21] Appl. No.: 751,003

[22] Filed: Dec. 15, 1976

[51] Int. Cl.[2] ..... D06M 15/36

[52] U.S. Cl. ..... 252/8.6; 8/115.6 A; 260/648 F; 428/96

[58] Field of Search ..... 252/8.6; 8/115.6 A; 428/96; 260/648 F, 653

[56] References Cited

U.S. PATENT DOCUMENTS

| | | | |
|---|---|---|---|
| 2,764,603 | 9/1956 | Ahlbrecht | 260/404.5 |
| 2,951,051 | 8/1960 | Tiers | 260/23 XA |
| 3,282,905 | 11/1966 | Fasick et al. | 252/8.6 UX |
| 3,433,666 | 3/1969 | Moyse et al. | 427/390 R |
| 3,544,501 | 12/1970 | Fearnley et al. | 428/96 |
| 3,668,233 | 6/1972 | Paulick | 8/115.6 |
| 3,678,068 | 7/1972 | Anello et al. | 560/184 |
| 3,821,290 | 6/1974 | Anello et al. | 260/513 R |
| 3,916,053 | 10/1975 | Sherman et al. | 428/96 |
| 4,007,305 | 2/1977 | Kakar et al. | 8/115.6 A |

*Primary Examiner*—William E. Schulz

*Attorney, Agent, or Firm*—Alan M. Doernberg

[57] ABSTRACT

A fabric coating composition, including a polymer having a glass transition temperature above room temperature, an ionic fluorinated surfactant and a carrier. The preferred fluorinated surfactants have 5 to 30 carbons per hydrophylic end and include fluoro ether surfactants having radicals of the formula $(CF_3)_2CFOCF_2CF_2$— or fluoroalkyl surfactants having radicals of the formula $CnF_{2n+1}$— where $n$ is 6 to 12. The polymer may be dissolved or, preferably, emulsified by an emulsifier to form a latex. The polymer is preferably applied to fabric at a rate giving a dry solids content of about 0.25 to 10%, to give dry soil resistance.

37 Claims, No Drawings

FABRIC COATING COMPOSITIONS, METHOD AND COATED FABRIC HAVING DRY SOIL RESIST FINISHES

BACKGROUND OF THE INVENTION

This invention relates to a process for rendering fabrics, particularly pile fabrics such as carpeting, resistant to soiling.

"Fabrics" as used herein means textile fabrics manufactured from natural or synthetic textile fibers. Synthetic fibers are those fibers manufactured from organic polymeric materials such as polyamides, including nylon, polynitriles such as polyacrylonitriles and polyacrylates such as polymethylmethacrylate and copolymers of polynitriles and polyacrylates. Natural fibers include cotton, wool, silk and regenerated cellulose fibers such as rayon. Fabrics which are treated in accordance with the process of the invention include both woven and pile fabrics but pile fabrics are of particular interest in that they have a particular tendency to pick up soils. Of particular interest are carpets having a pile composed of natural or synthetic fibers since such carpets tend to soil particularly rapidly.

Carpets which are resistant to soiling in the sense that they soil to a lesser degree or less rapidly are therefore particularly advantageous. Pile fabrics, and in particular upholstery fabrics, which are composed of natural or synthetic fibers, are similarly prone to rapid soiling in use and such fabrics which are resistant to soiling are likewise advantageous.

In the prior art, fabrics, particularly carpets and pile upholstery fabrics, were treated to improve soil resistance. Prior art compositions for treating fabrics such as carpets, were not generally acceptable in that soil resistance and particularly dry soil resistance was not sufficiently enhanced and since wear resistance of the compositions was poor. Some of the better compositions for improving soil resistance contained fluorine containing polymers. Such compositions, while being an improvement over compositions which contained no fluorine, generally still do not provide as much soil resistance as was desired, and wear characteristics of the compositions were generally poor.

For simplicity, the fabric with all additives except the present composition will be referred to as "fiber". Polymer treated fabrics are known. For example, fabrics treated with methyl methacrylates are disclosed in U.S. Pat. No. 3,433,666.

Fluorinated, nonpolymeric surfactants are also known. Fluorinated sulfonic acids and salts are disclosed in British Pat. No. 1,261,767 and German Pat. No. 1,935,991. U.S. Pat. No. 3,821,290 discloses perfluoroisoalkoxyalkyl sulfonic acids. Perfluoro substituted diphatic acids are disclosed in U.S. Pat. No. 2,951,051. French Pat. No. 1,463,275 discloses methacrylate polymer in conjunction with surface active agents to provide dry soil resistance to carpets. British Pat. No. 1,155,552 discloses polystyrene emulsions in conjunction with surface active agents.

BRIEF DESCRIPTION OF THE INVENTION

The dry soil resistant fabric finish of the invention includes a polymer with a glass transition transmission above room temperature, a fluoro surfactant having 5 to 30 carbons per hydrophilic end and a carrier. The polymer is preferably a cationic latex produced with an emulsifier. The emulsifier itself is preferably cationic.

The nonpolymeric, fluoro surfactant preferably has either a $(CF_3)_2CFOCF_2CF_2$— radical or a $C_nF_{2n+1}$— radical, where $n$ is 6 to 12. The polymer is preferably essentially non-halogenated.

The preferred finish composition is from about 0.25 to about 45 percent (by weight of composition) polymer, from about 0.5 to about 50 percent (by weight of polymer) fluoro surfactant and the remainder (at least 40% by weight of composition) carrier, preferably water. More preferably, the fluoro surfactant is about 1-10% by weight of polymer.

The preferred method of the invention includes applying the above composition to a textile fabric.

The preferred fabric includes from about 0.25 to about 10 percent by weight polymer, about 2 to about 10 percent (by weight of polymer) ionic emulsifier and from about 0.5 to about 50 percent (by weight of polymer) fluoro surfactant, with the remainder fiber (including all additives except the present composition).

DETAILED DESCRIPTION OF THE INVENTION

The compositions of the invention include a polymer component, a fluorinated surfactant component and a carrier component. Preferably, the polymer is a latex, with sufficient amounts of an ionic, and preferably cationic emulsifier to suspend the polymer. About 0.5 to about 50% by weight of polymer is the ionic fluorinated surfactant with from 5 to 30 carbons per hydrophilic end. The balance of the composition, which would be at least 45% by weight of the entire composition, is a liquid carrier.

A wide variety of polymers, both homopolymers and copolymers, are suitable for the present compositions. Nonhalogenated polymers are preferred. Any significant halogen content produces glass transition temperature below room temperature and thus a sticky polymer. Exemplary monomeric units are derived from alkyl methacrylates, styrenes, alkyl acrylates, olefins and mixtures thereof. The criteria for suitable polymers is a glass transition temperature above room temperature (about 25° C). A list of polymers with their glass transition temperatures may be found at pages III-64 and through III-84 of "Polymer Handbook" by J. Brandrup and E. H. Immergut (N.Y., 1966).

Other exemplary polymers include poly(hexadecyl acrylate), poly(isobornyl acrylate), poly(tetradecyl acrylate), poly(isobornyl methacrylate). It should be appreciated that glass transition temperature is somewhat additive with many copolymers such that a copolymer may have a sufficiently high glass transition temperature even though, considering its predominant monomeric unit, the homopolymer would not have a glass transition temperature above room temperature.

The monomeric units for such polymers include lower alkyl methacrylate and especially methyl methacrylate. Other monomeric units include, by way of example, 3-3-dimethyl-1-butene; 3-methyl-1-butene; isobornylacrylate; cyclohexylmethacrylate; isobutylmethacrylate; 5-tert-butyl-2-methylstyrene; styrene; N-vinylpyrralidone; diacetone acrylanide; and 3-vinyl pyridine. Copolymers may be used with more than one of the above exemplary monomeric units, such as: methylmethacrylate/N-vinylpyrrolidone 80/20 copolymer, ethyl methacrylate-diacetone acrylamide 80/20 copolymer, styrene/acrylonitrile 50/50 copolymer, and styrene/-maleic anhydride 50/50 copolymer.

Other monomeric units may also be incorporated into copolymers. Among the preferred copolymers is that of methyl methacrylate with N-methylol acrylamide, with the methyl methacrylate being more than 90%, and preferably about 98.5%, of the monomeric units.

A broad range of known polymers can be used in the present invention so long as the temperature of glass formation is above room temperature. Typically, such polymers have molecular weight from about 20,000 to about 2,000,000 although this range is not critical.

The composition of the present invention may, in some forms, be prepared with the polymer dissolved in carrier. However, many preferred polymers are prepared as a latex or emulsion in the carrier with the use of an emulsifier in amounts sufficient to suspend the monomer sources in the carrier during polymerization, and to hold the polymer suspended as a latex. It will be appreciated that such amounts can be determined by routine experimentation. Such latexes are well known in the art, and as can be appreciated, many polymers can be prepared with cationic, anionic or nonionic emulsifiers. As will also be appreciated, cationic emulsifiers produce a cationic environment for the polymer or a "cationic latex" and anionic emulsifiers produce an anionic environment for the polymer or an "anionic latex". Nonionic emulsifiers give no charge to the polymer, and therefore in spite of any small charge on the polymer itself, such latexes are regarded as nonionic.

The emulsifiers of the composition may be selected from a broad range of materials. While, in general, cationic primary emulsifiers are preferred, it will be understood that the emulsifier chosen must usually be compatible with the fluoro surfactant. Noncompatible emulsifiers (an anionic emulsifier with a cationic fluoro surfactant or vice versa) may be used, but must be prepared carefully to avoid destabilization of the latex when fluoro surfactant is added. Exemplary primary emulsifiers include cetyltrimethyl ammonium bromide, which is preferred with methyl methacrylate polymers.

Other exemplary cationic emulsifiers include: Barquat MX50 [alkyldimethylbenzyl ammonium chloride], Hyamine 2389 [methyldodecylbenzyl trimethyl ammonium chloride 80%/methyldodecylxylylene bis (trimethyl ammonium chloride) 20%] and Hyamine 10X [diisobutylcresoxyethoxyethyl dimethyl ammonium chloride].

In general, such cationic emulsifiers are preferred to nonionic and anionic emulsifiers. Preferrably, the cationic emulsifier is sufficiently charged to cause the latex of polymer and emulsifier to be cationic. In some forms, and with certain polymers, anionic or nonionic emulsifiers could still be used in the composition.

For example, anionic surfactants such as sodium laurel sulfate may be used as emulsifiers in compositions with certain polymers. However, with the preferred lower alkyl methacrylate polymers suspended in sodium laurel sulfate, dry soil resistance is not materially improved.

The fluorinated surfactant of the composition can be anionic or cationic with, respectively, negative and positive hydrophilic groups. These compounds should have 5–30, and preferably 6–20 and most preferably 6–12 carbons per hydrophilic group. Thus the exemplary dimer acids below could have up to 60 carbons. Preferably, the surfactant and emulsifier are compatible as discussed above. Exemplary anionic groups include carboxylic groups, bisulfate and sulfate groups. Exemplary cationic groups include tertiary ammonium halides. Many such compounds are disclosed in U.S. Pat. No. 3,899,366, incorporated herein by reference. Exemplary structures include the following:

(a) Segmented Carboxylic Acid $$C_nF_{2n+1}(CH_2)_mCOOM$$

where:

$n$ = 6–12 and $m$ is 0–11

M = H or alkali metal $$(CF_3)_2CFOCF_2CF_2(CF_2)_n(CH_2)_mCOOM$$

where:

$n$ = 2–12, $m$ is 0–10, M = H or alkali metal (b) Dimer Acids $$\begin{array}{l}(CF_3)_2CFOCF_2CF_2(CF_2CF_2)_nCH_2CH(CH_2)_mCOOM\\ \qquad\qquad\qquad\qquad\qquad\qquad\qquad\qquad\quad |\\ (CF_3)_2CFOCF_2CF_2(CF_2CF_2)_nCH_2CH(CH_2)_mCOOM\end{array}$$

where:

$n$ = 0–5, $m$=0–8, M = H or alkali metal (c) As in (b) above where the fluoroalkyl segment is $C_nF_{2n+1}$ where:

$n$ = 6–12

(d) Segmented Sulfonic Acids $$(CF_3)_2CFOCF_2CF_2(CF_2CF_2)_n(CH_2)_mSO_3M$$

where:

$n$ = 0–5, $m$ = 0–10, M = akali or alkaline earth metal (e) As in (d) above where the fluoroalkyl segment is $C_nF_{2n+1}$ where:

$n$ = 0–5

(f) Quaternized Haloalkyl Esters of Perfluoroalkoxy Alkanols $$(CF_3)_2CFOCF_2CF_2(CF_2CF_2)_n(CH_2)_mO\overset{\overset{\displaystyle O}{\|}}{C}CH_2N^+(Et)_3Cl^-$$

where:

$n$ = 0–5, $m$ = 0–5, Et is ethoxy (g) As in (f) above where the fluoroalkyl segment is $C_nF_{2n+1}$ where:

$n$ = 6–12

(h) Quaternized N-Halomethyl Amides of Fluoro Acids

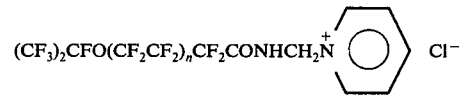

where: $n$ =1–5

(i) As in (h) above where the fluoroalkyl segment is $C_nF_{2n+1}$ where:

$n$ = 6–12

(j) Isothiouronium Halides $$[(CF_3)_2CFO(CF_2CF_2)_nCH_2CH_2SC(NH_2)_2]^+ I^-$$

where:

$n = 1–5$ (k) As in (j) above where the fluoroalkyl segment is $C_nF_{2n+1}$ where:

$n = 6–12$

Preferred fluorinated surfactants include one of the following radicals:

$(CF_3)_2CFOCF_2CF_2(CF_2CF_2)_n$— with $n = 0$ to 5

$C_nF_{2n+1}$— with $n = 6$ to 12.

Such preferred radicals include $(CF_3)_2CFO(CF_2)_{12}$—; $(CF_3)_2CFOCF_2CF_2$—; $C_6F_{13}$—; $C_9F_{19}$— and $C_{12}F_{25}$—.

Thus, preferred fluoro surfactants include such compounds and salts as:

$(C_6F_{13})COOH$; $(C_8F_{17})(C_5H_{10})COO^-Li^+$; $(C_{12}F_{25})COO^-Na^+$;

$(C_6F_{13})(C_{11}H_{22})COO^-K^+$; $(CF_3)_2CFOCF_2CF_2(CF_2)_2COOH$;

$(CF_3)_2CFOCF_2CF_2(CF_2)_{12}(CH_2)_5COO^-K^+$;

$(CF_3)_2CFOCF_2CF_2(CF_2)_4(CH_2)_{10}COO^-Li^+$;

$(CF_3)_2CFOCF_2CF_2CH_2CH(CH_2)_8COO^-Na^+$ $(CF_3)_2CFOCF_2CF_2CH_2CH(CH_2)_8COO^-Na^+$;

$(CF_3)_2CFOCF_2CF_2(CF_2CF_2)_5CHCOOH$ $(CF_3)_2CFOCF_2CF_2(CF_2CF_2)_5CHCOOH$;

$(C_6F_{13})CH_2CH(CH_2)_2COOH$ $(C_6F_{13})CH_2CH(CH_2)_2COOH$;

$(C_{12}F_{25})CH_2CH(CH_2)_4COO^-Na^+$ $(C_{12}F_{25})CH_2CH(CH_2)_4COO^{-Na+}$;

$(C_8F_{17})CH_2CH(CH_2)_8COO^-K^+$ $(C_8F_{17})CH_2CH(CH_2)_8COO^-K^+$;

$(CF_3)_2CFOCF_2CF_2(CH_2)_{10}SO_3^-K^+$;

$(CF_3)_2CFOCF_2CF_2(CF_2CF_2)_5(CH_2)_4CO_3H$;

$(CF_3)_2CFOCF_2CF_2(CF_2CF_2)_{10}(CH_2)_2SO_3^-\ {}_2Ca^{++}$;

$(C_6F_{13})(CH_2)_2SO_3\ {}^-{}_2Mg\ {}^{++}$;

$(C_{12}F_{25})(CH_2)_{10}SO_3^-Na^+$;

$(CF_3)_2CFOCF_2CF_2(CH_2)_5OCOCH_2N^+(Et)_3Cl^-$;

$(C_6F_{13})(CH_2)_3OCOCH_2N^+(Et)_3Cl^-$;

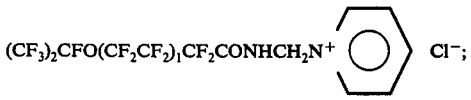

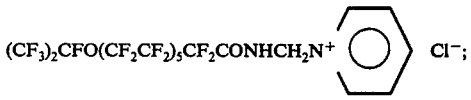

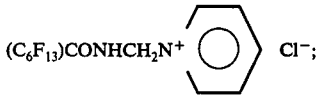

-continued

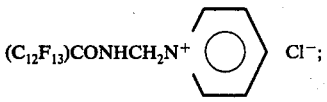

$[(CF_3)_2CFO(CF_2CF_2)CH_2CH_2SC(NH_2)_2]^+I^-$;

$[(CF_3)_2CFO(CF_2CF_2)_2CH_2CH_2SC(NH_2)_2]^+I^-$;

$[(C_6F_{13})CH_2CH_2SC(NH_2)_2]^+I^-$; and $[(C_{12}F_{25})CH_2CH_2SC(NH_2)_2]^+I^-$.

A broad range of carrier solvents may be used according to the present invention. With appropriate polymer, surfactant and emulsifier, water may be used as the preferred carrier. If necessary, more expensive organic solvents may be used.

The preferred dry soil resistant compositions of this invention consists of a mixture of poly(lower alkyl methacrylate) and a fluorosurfactant described above in the ratio of from about 99.5 parts poly(lower alkyl methacrylate) to 0.5 parts fluorosurfactant, to about 50 parts methacrylate to 50 parts fluorosurfactant. The preferred composition consists of about 94 parts methacrylate to 6 parts fluorosurfactant all on a dry solids basis. The dry soil resistant formulation may have a solids content ranging between 0.5% to 50% with the preferred concentration at the time of application being about 0.5–20% solids.

The preferred formulations are mixed by polymerizing the polymer or copolymer in the presence of some carrier and of the primary emulsifier, adding the fluoro surfactant, and diluting with carrier before use. Alternatively, fluoro surfactant may be added to the dissolved polymer.

Fluorochemical quaternary ammonium surfactants may also be used as the primary emulsifier. However, the hydrocarbon emulsifiers are generally preferred because they generally give a more stable latex and a higher solids content emulsion. The use of a fluorochemical primary emulsifier in the polymerization is expensive and gives a product with no better dry soil resistance than provided by polymers made with hydrocarbon emulsifiers to which the fluoro surfactant has been added after the completion of the polymerization.

In actual operation, the carpet finisher would dilute the composition so as to provide a pad or spray composition containing about 0.25–10% solids. The fabric would thus be about 0.25–10% polymer and about 0.05 to 50% fluoro surfactant (by weight of polymer). If the composition was a latex, some emulsifier would also be included. The remainder of the fabric would be fiber (including other additives). The actual bath concentration will depend on the pick-up which is in turn a function of line speed, mode of application, etc. In general, deposition of between 1 and 4% solids gives optimum dry soil resistance. As a general rule, application sufficient to deposit about 0.25–9% preferably about 1–4% polymer by weight of fiber gives sufficient dry soil resistance.

After spraying or padding, the carpet is generally passed through a drying device to remove solvent or moisture. Temperature or residence in the drying device is not critical to performance nor is a cure necessary for satisfactory performance.

The fluoro surfactants of the invention have been found neither to interfere with the dye in fabrics nor to block dyeing of pretreated fibers or fabrics.

The various groups of fluoro surfactants may be synthesized by known techniques. For example, some mechanisms are shown in Table I:

| | Intermediate or Group of Fluoro Surfactant | Method of Synthesis | Reference(s) |
|---|---|---|---|
| | $R_fI=C_mF_{2m+1}I$ or $(CF_3)_2CFO(CF_2CF_2)I$ | | U.S. Pat. Nos. 3,641,083 3,651,105 3,678,068 |
| a) | Segmented Carboxylic Acids | $R_fI+CH_2{=}CH(CH_2)_mCOOM$ ↓ $R_fCH_2CHI(CH_2)_mCOOM$ ↓ NaOH $R_fCH{=}CH(CH_2)_mCOOM$ ↓ [H] $R_fCH_2CH_2(CH_2)_mCOOM$ | U.S. Pat. Nos. 2,951,051 3,231,604 3,697,564 |
| b & c) | Dimer Acids | $R_fCH_2CHI(CH_2)_mCOOM$ ↓ Zn, Ethanol $R_fCH_2CH(CH_2)_mCOOH$ $R_fCH_2CH(CH_2)_mCOOH$ | [from synthesis of a] U.S. Pat. No. 3,899,366 |
| d & e) | Segmented Sulfonic Acids | $R_f(CH_2)_mI+KSCN$ ↓ $R_f(CH_2)_mSCN$ ↓ $Cl_2$, $H_2O$ $R_f(CH_2)_mSO_2Cl$ MOH $R_F(CH_2)_mSO_3M$ | U.S. Pat. No. 3,821,290 |
| f & g) | Quaternized Haloalkyl Esters | $R_f(CH_2)_mOH+CH_2ClCOCl$ ↓ $R_f(CH_2)_mO\overset{O}{\overset{\|\|}{C}}CH_2Cl$ ↓ $N(Et)_3$ $R_f(CH_2)_mO\overset{O}{\overset{\|\|}{C}}CH_2\overset{+}{N}(ET)_3Cl^-$ | 3,563,999 |
| h & i) | Quaternized N-Halomethyl Amides | $R_f(CH_2)_mCOOH$ [from a] ↓ $SOCl_2$ $R_f(CH_2)_mCOCl_2$ ↓ $NH_3$ $R_f(CH_2)_mCONH_2$ ↓ CH20, 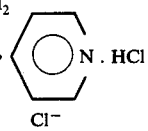 N . HCl $Cl^-$ | U.S. Pat. No. 3,674,800 see 3,681,413 2,764,602 2,764,602 2,764,603 |

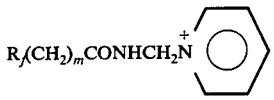

-continued

| Intermediate or Group of Fluoro Surfactant | Method of Synthesis | Reference(s) |
|---|---|---|
| j & k) Isothiouronium Halides | $R_fCH_2CH_2I + NH_2\overset{\overset{S}{\|}}{C}NH_2 \rightarrow [R_fCH_2CH_2SC(NH_2)_2]^+\pm^-$ | see Roberts & Caserio PRINCIPLES OF ORGANIC CHEMISTRY 750 (1964) |

EXAMPLE 1—Techniques for Dry Soil Resist Tests and Evaluation

VACUUM CLEANER SOIL

Vacuum cleaner disposable bags were collected from several residential homes and the soil removed from them. It was then sterilized in a circulating oven at 125° C for one hour. The sterilized soil was then freed from hairs, lint, larger solid particles, etc., and sifted through a 40 mesh screen. Finally, the soil was sifted through a 100 mesh screen and stored in jars. The jars were rotated on a ball mill for one hour to homogenize the soil.

ACCELERATED SOILING METHOD

The accelerated soiling method used was essentially the same as American Association of Textile Chemists and Colorists (AATCC) Test Method 123-1970. It consisted of placing two specimens of the carpet (one treated and one untreated) in a porcelain ball mill jar with the back of each specimen against the inside cylindrical surface. The two specimens had been, initially, cut from the same piece of carpet in the same direction of construction. Ten grams of the soil were placed as uniformly as possible and 50 flint pebbles were added in the jar. The cover was now fastened and the jar rotated for 15 minutes on the ball mill at about 75-80 RPM. A large number of experiments had shown, earlier, that under these conditions the carpet specimens were always evenly soiled.

At the end of 15 minutes, the ball mill was stopped, the specimens removed and shaken free of excess dirt. Now the specimens were individually cleaned by using a tank type vacuum cleaner. Cleaning was continued till no further improvement could be seen in the appearance of the specimen.

RATING OF DRY SOIL RELEASE PERFORMANCE

The two soiled specimens (treated and untreated) were compared, under uniformly diffused good lighting conditions, against each other. In most of the cases, ratings were given as under.

- 0 = Worse dry soiling than the untreated soiled specimen.
- 50 = Dry soiling equal to the untreated soiled specimen.
- 70 = Dry soiling slightly less than the untreated soiled specimen
- 80 = Dry soiling noticeably less than the untreated soiled specimen
- 90 = Dry soiling considerably less than the untreated soiled specimen
- 95 = Dry soiling significantly less than the untreated soiled specimen
- 100 = Dry soiling produces no visible effects versus unsoiled fabric samples In many cases, it becomes difficult to assign number ratings to treated samples when their dry soil release performance was between 95 and 100. In such cases, a ranking method can be used with advantage. Such methods have been described by various authors. Essentially, the procedure consists of the following. An operator is asked to arrange (coded) soiled and vacuumed samples in order of their increasingly better appearance. The sample with least soiling gets #1 and the one with heaviest soiling is assigned the last number in a given batch of samples. This procedure is then repeated by another operator. There is no limit to the number of operators that can be employed. Usually, three or five operators are considered satisfactory. Average ratings then can be used to assign relative measure of goodness of different treatments. This method also lends itself excellently to statistical analysis and is a popular tool in the hands of statisticians. This ranking method has been used in assessing relative goodness of various treatments described in this disclosure.

APPLICATION

During this study, all aqueous based formulations were applied by soaking the carpet pieces in the pad bath for 30 seconds and then squeezing through a Butterworth padder. Pressure on the rolls of the Butterworth padder was adjusted to give about 100% wet pick up. The wet samples of the carpet were pin framed and dried in an air circulating oven at 125° C.

When a dry soil release finish was applied from solvent solutions, an electrically driven Atlas laboratory wringer was used. Solution concentration and wet pick up were adjusted to deposit the desired amount of the finish on the carpet fibers. The wrung samples were pin framed, air dried and further dried in an air circulating oven at 125° C for about 15 minutes.

In all these evaluations, nylon-6 carpet dyed brilliant gold, was used. The color of this carpet was chosen specifically to show better differences in degree of soiling. This carpet had jute primary backing. No secondary backing was applied.

EXAMPLE 2

DRY SOIL RELEASE OF POLYMER OR COPOLYMER, FLUOROSURFACTANT, AND COMBINATION

Cationic latices of polymethyl methacrylate or copolymethyl methacrylate — N-methylol acrylamide 98.5/1.5 (both prepared by emulsion polymerization with the help of cationic emulsifier cetyl trimethyl ammonium bromide) were applied to nylon carpet. Also, in this series of investigations, several fluorinated surface active agents were applied to identical carpet by techniques described in Example 1. In addition to the above two types of finishes, identical nylon pieces were treated with formulations containing the hydrocarbon cationic latex (polymethyl methacrylate or copolymethyl methacrylate — N-methylol acrylamide) and one of the hydrocarbon surface active agents described above under this example.

The treated pieces were soiled and evaluated by methods described in Example 1. The results are summarized in Table II.

TABLE II

| TREATMENT | LEVEL APPLIED (% OWF) | DRY SOIL RELEASE |
|---|---|---|
| 1. Copoly MMA/NMA (Cationic; prepared by using cetyl trimethyl ammonium bromide) | 2.0 (Solids) | 95 |
| 2. Poly MMA (Cationic; prepared by using cetyl trimethyl ammonium bromide) | 2.0 (Solids) | 95 |
| 3. $CF_3(CF_2)_6COOH$ | 0.06 (F) | 70 |
| 4. $C_3F_7OC_2F_4(CH_2)_{10}COOH$ | 0.06 (F) | 85 |
| 5. $C_3F_7OC_8F_{16}(CH_2)_{10}COOH$ | 0.06 (F) | 95 |
| 6. $3F_7OC_8F_{16}—CH_2—CH—(CH_2)_8COOH$ \| $C_3F_7OC_8F_{16}—CH_2—CH—(CH_2)_8COOH$ | 0.06 (F) | 60 |
| 7. $(C_3F_7OC_2F_4C_2H_4SC(NH_2)_2)^+I^-$ | 0.06 (F) | 90 |
| 8. $C_3F_7OC_4F_8(CH_2)_{11}OCOCH_2N^+(C_2H_5)_3Cl^-$ | 0.06 (F) | > 90 but < 95 |
| 9. $C_3F_7OC_6F_{12}CH_2CH_2SO_3H$ | 0.06 (F) | Better than #1 or #2 above |
| 10. Copoly MMA/NMA (as in #1 above) + $C_3F_7(CF_2)_6COOH$ | 2.0 (Solids) + 0.06 (F) | Better than #1 or #3 above |
| 11. Copoly MMA/NMA (as in #1 above) + $C_3F_7OC_2H_4(CH_2)_{10}COOH$ | 2.0 (Solids) + 0.06 (F) | Better than #1 or #4 above |
| 12. Copoly MMA/NMA (as in #1 above + $C_3F_7OC_8F_{16}(CH_2)_{10}COOH$ | 2.0 (Solids) + 0.06 (F) | Better than #1 or #5 above |
| 13. Copoly MMA/NMA (as in #1 above + $C_3F_7OC_8F_{16}—CH_2—CH—(CH_2)_8CO_2H$ $C_3F_7OC_8F_{16}—CH_2—CH—(CH_2)_8CO_2H$ | 2.0 (Solids) + 0.06 (F) | Better than #1 or #6 above |
| 14. Poly MMA (as in #2 above) + $C_3F_7OC_8F_{16}—CH_2—CH—(CH_2)_8CO_2H$ $C_3F_7OCH_8F_{16}—CH_2—CH—(CH_2)_8CO_2H$ | 2.0 (Solids) + 0.06 (F) | Better than #2 or #6 above |
| 15. Copoly MMA/NMA (as in #1 above) + $(C_3F_7OC_2F_4C_2H_4SC(NH_2)_2)^+ I^-$ | 2.0 (Solids) + 0.06 (F) | Better than #1 or #7 above |
| 16. Copoly MMA/NMA (as in #1 above) + $C_3F_7OC_2F_4(CH_2)_{11}OCOCH_2N^+(C_2H_5)_3Cl^-$ | 2.0 (Solids) + 0.06 (F) | Better than #1 or #8 above |
| 17. Copoly MMA/NMA (as in #1 above) + $C_3F_7OC_6F_{12}CH_2CH_2SO_3H$ | 2.0 (Solids) + 0.06 (F) | Better than #1 or #9 above |

Unexpected results were seen (Table II) when the dry soil performance of the formulations, containing the hydrocarbon cationic latex and a fluorochemical surface active agent, was compared with that of the hydrocarbon or the fluorochemical surface active agent applied individually. The performance of a given formulation was dramatically superior fo that of either of the component treating agents applied alone. Although no explanation is advanced for such an unexpected behavior, it is clear that a definite synergism exists between the cationic polymeric or copolymeric latex and the fluorochemical surface active agent. Such synergism is exhibited irrespective of the ionic charge on the surface active fluorochemical moiety. Formulations of the sulfonic acid $C_3F_7O(CF_2)_nCH_2SO_3H$, where $n$ = 6, 8 or 10, with cationic latices were particularly effective in dramatically improving the soil release performance.

EXAMPLE 3

A test was run according to the procedure described in Example 1 using some of the polymers and fluoro surfactants of the present invention, some of the compositions of the present invention and some commercial products. The results, set forth in Table III, demonstrate the effectiveness of the compositions of the present invention in resisting soiling.

TABLE III

PERFORMANCE COMPARISON OF SOME SOIL RESISTANCE PRODUCTS FOR CARPETS

| FINISH APPLIED | LEVEL APPLIED (% OWF) | SOIL RESISTANCE PERFORMANCE | |
|---|---|---|---|
| 1. MMA/NMA (98.5:1.5) | 4.0% (Solids) | After accelerated soiling for 15 minutes | 96 |
| 2. $C_3F_7OC_6F_{12}C_2H_4SO_3H$ | 0.06% (Fluorine) | After accelerated soiling for 15 minutes | 96 |
| 3. $C_3F_7OC_6F_{12}C_2H_4SO_3H$ MMA/NMA (98.5:1.5) | 0.06% (Fluorine) 2.0% (Solids) | After accelerated soiling for 15 minutes | 98 |
| 4. $C_3F_7OC_4F_8 \cdot C_{10}H_{20}COOH$ | 0.06% (Fluorine) | After accelerated soiling for 15 minutes | 96 |
| 5. $C_3F_7OC_4F_8C_{10}H_{20}COOH$ MMA/NMA (98.5:1.5) | 0.06% (Fluorine) 2.0% (Solids) | After accelerated soiling for 15 minutes | 97 |
| 6. Cl OH $H_2C\text{-}HC\text{-}H_2C\text{-}CO_2 \quad CO_2 \cdot C_2H_4 \cdot R_f$ $ClH_2C\text{-}HC\text{-}H_2C\text{-}CO_2 \quad CO_2 \cdot C_2H_4 \cdot R_f$ | 0.06% (Fluorine) | After accelerated soiling for 15 minutes | 98 |
| 7. Scotchgard (Carpet Protector) (3M) | 0.06% (Fluorine) | After accelerated soiling for 15 minutes | — |
| 8. Scotchgard FC-214 (3M) | 0.06% (Fluorine) | After accelerated soiling for 15 minutes | 95 |
| 9. Tinotop T-20 (Ciba Geigy) | 0.06% (Fluorine) | After accelerated soiling for 15 minutes | 93 |

TABLE III-continued

PERFORMANCE COMPARISON OF SOME SOIL RESISTANCE PRODUCTS FOR CARPETS

| FINISH APPLIED | LEVEL APPLIED (% OWF) | SOIL RESISTANCE PERFORMANCE | |
|---|---|---|---|
| 10. Tinotop T-3 (Ciba Geigy) | 1.5% (Product) | After accelerated soiling for 15 minutes | 0 |
| 11. Zepel-3356 B | 0.06% (Fluorine) | After accelerated soiling for 15 minutes | 70 |
| 12. Juvenon Soil Retardant #10 (American Cyanamid) | 1.0% (Solids) | After accelerated soiling for 15 minutes | 95 |

The unexpected results of Table III are particularly striking when one considers the relatively low fluorine content of Finishes 3 and 5. It should be noted that some prior art products contain a fluoroalkyl methacrylate polymer. It is surprising that the fluoroalkyl surfactants used in the composition of this invention are effective in promoting soil resistance. Such surface active agents are known to be powerful wetting agents and would be expected to promote the penetration of soils, particularly liquid soils into substrates such as nylon carpet. Despite the fact that no hold-out of water or oils is provided, these fluoro surfactants, used in conjunction with poly(methyl methacrylate), provide superior dry soil resistance compared to such prior art compositions and 3M Scotchgard® products. This is particularly surprising in view of the fact that the fluoropolymer content of these prior art compositions run as high as 40% while the fluorosurfactant adjuvant in the composition of this invention is used at levels of between 10 and 5%.

Other suitable dry resist formulations are mixed as shown in Table IV.

TABLE IV

| Polymer | Combined Weight Percentage | Emulsifier** | Fluoro surfactant Weight Percentage | Carrier Weight Percentage |
|---|---|---|---|---|
| 1. Poly(hexadecyl acrylate) | 45% | sodium lauryl sulfate | $(CF_3)_2CF(CF_2)_3(CH_2)_3COSO_3^-Na^+$ 10% | water 45% |
| 2. Poly(isobornyl acrylate | 0.25% | Triton X-200* | $(CF_3)_2CF(CF_2)_9(CF_2)_6CO_2^-K^+$ 0.10% | water 99.65% |
| 3. Poly(tetradecyl acrylate) | 10% | Triton X-305* | $(CF_3)_2CF(CF_2)_3CH(CH_2)_5COOH$ \| $(CF_3)_2CF(CF_2)_3CH(CH_2)_5COOH$ 0.005% | water 89.995% |
| 4. Poly(isobornyl methacrylate) | 10% | alkyldimethyl-benzyl ammonium chloride | $(CF_3)_2CFOCF_2CF_2CF_2(CF_2CF_2)_5(CH_2)_5OCH_2N^{30}(ET)_3Cl^-$ 1% | water 89% |
| 5. Poly(ethyl methacrylate) | 5% | 80% methydodecyl-benzyl ammonium chloride 20% methyldodecyl-xylylene bis(tri-methyl ammonium chloride) | $(CF_3)_2CF(CF_2)_3(CH_2)_5OCOCH_2N^+(Et)_3Cl^-$ 2% | water 50% ethanol 43% |
| 6. Poly(methyl methacrylate) | 20% | diisobutylcresoxy-ethyxyethyl dimethyl ammonium chloride | $(CF_3)_2CFO(CF_2CF_2)_5CF_2CONHCH_2N^+$ 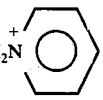 $Cl^-$ 2% | water 78% |
| 7. Poly(3,3-dimethyl-1-butene) | 20% | Triton X-305* | $[(CF_3)_2CFO(CF_2CF_2)_6(CH_2)_{10}SO_3^-]_2Ca^{++}$ 8% | water 72% |
| 8. Poly(3-methyl-1-butene) | 1% | Triton X-305* | $(CF_3)_2CFO(CH_2)_5SO_3^-Li^+$ 0.25% | water 98.75% |
| 9. Poly(cyclohexyl methacrylate) | 2% | sodium lauryl sulfate | $(CF_3)_2CF(CF_2CF_2)_3SO_3^-K^+$ 0.50% | water 47.50% isopropanol 50% |
| 10. Poly(isobutyl methacrylate) | 2% | Triton X-305* | $(CF_3)_2CFOCF_2CF_2(CF_2)_{12}(CH_2)_5COO^-Na^+$ 0.02% | water 97.97% |
| 11. Poly(5-tert-butyl-2-methystyrene) | 1% | Cetyl trimethyl ammonium bromide | $(CF_3)_2CFOCF_2CF_2(CF_2)_2(CH_2)_5COOH$ 0.06% | water 98.94% |
| 12. Poly(styrene) | 0.50% | Cetyl trimethyl ammonium bromide | $(CF_3)_2CFOCF_2CF_2CH_2CH(CH_2)_4COOH$ \| $(CF_3)_2CFOCF_2CF_2CH_2CH(CH_2)_4COOH$ 0.02% | water 99.48% |
| 13. Poly(N-vinyl pyrralidone) | 0.50% | Triton X-200* | $(CF_3)_2CFOCF_2CF_2(CF_2CF_2)_5CH_2CH(CH_2)_4COO^-K^+$ \| $(CF_3)_2CFOCF_2CF_2(CF_2CF_2)_5CH_2CH(CH_2)_4COO^-K^+$ | water 99.48% |
| 14. Poly(diacetone acrylanide) | 1% | Triton X-200* | $(CF_3)_2CFOCF_2CF_2(CF_2CF_2)_3CH_2CH(CH_2)_8COO^-Na^+$ \| $(CF_3)_2CFOCF_2CF_2(CF_2CF_2)_3CH_2CH(CH_2)_8COO^-Na^+$ 0.01% | water 98.99% |

TABLE IV-continued

| | Polymer | Combined Weight Percentage | Emulsifier** | Fluoro surfactant Weight Percentage | Carrier Weight Percentage |
|---|---|---|---|---|---|
| 15. | Poly(3-vinyl pyridine) | 0.5% | Cetyl trimethyl ammonium bromide | $(CF_3)_2CFOCF_2CF_2CONHCH_2N^+$ 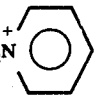 $Cl^-$ 0.01% | water 99.49% |
| 16. | Ethyl methacrylate 80%, diacetone acylanide 20% copolymer | 0.5% | Cetyl trimethyl ammonium bromide | $CF_3(CF_2)_5CONHCH_2N^+$ 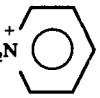 $Cl^-$ 0.01% | water 99.49% |
| 17. | Styrene 50% acrylonitrile 50% copolymer | 0.5% | Alkyldimethylbenzyl ammonium chloride | $(CF_3)_2CF(CF_2)_9CONHCH_2N^+$ 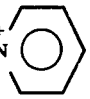 $Cl^+$ 0.01% | water 99.49% |
| 18. | Styrene 50% maleic anhydride 50% copolymer | 0.5% | Cetyl trimethyl ammonium bromide | $[(CF_3)_2CFOCF_2CF_2CH_2CHSC(NH_2)_2]^+I^-$ 0.02% | water 99.48% |
| 19. | Poly(methylmeth-acrylate) | 0.5% | Cetyl trimethyl ammonium bromide | $[(CF_3)_2CFO(CF_2CF_2)_5CH_2CH_2SC(CH_2)_2]^+I^-$ 0.02% | water 99.48% |
| 20. | Poly(methylmeth-acrylate) | 0.5% | Cetyl trimethyl ammonium bromide | $[(CF_3)_2CF(CF_2)_3CH_2CH_2SC(NH_2)_2]^+I^-$ 0.02% | water 99.48% |
| 21. | Poly(methylmeth-acrylate) | 0.5% | Cetyl trimethyl ammonium bromide | $[(CF_3)_2CF(CF_2)_9CH_2CH_2SC(NH_2)_2]^+I^-$ 0.02% | water 99.48% |
| 22. | Methyl methacrylate N-methyloyl acryl-amide 20% copolymer | 0.5% | Cetyl trimethyl ammonium bromide | $(CF_3)_2CFOCF_2CF_2OCH_2N^+(Et)_3Cl^-$ 0.02% | water 99.48% |
| 23. | Methyl methacrylate 99.5% N-methyloyl acrylamide 0.5% copolymer | 0.5% | Cetyl trimethyl ammonium bromide | $(CF_3)_2CF(CF_2)_3OCOCH_2N^+(OCH_2CH_2)Cl^-$ 0.02% | water 99.48% |
| 24. | Methyl methacrylate 99.5% N-methyloyl acrylamide 0.5% copolymer | 0.5% | Cetyl trimethyl ammonium bromide | $(CF_3)_2CF(CF_2)_9(CH_2)_5OCOCH_2N^+(OCH_2CH_2)Cl^-$ 0.02% | water 99% ethanol .48% |

**sufficient emulsifier to form stable latex

*Trademarks of Rohm & Haas. Triton X-200 is anionic. Triton X-350 is nonionic.

We claim:

1. A composition consisting essentially of:

from about 0.25% to about 55% by weight of an essentially nonhalogenated polymer having a glass transition temperature above room temperature;

from about 0.05 to about 50% by weight of polymer of an ionic, non-polymeric fluoro surfactant with from 5 to 30 carbons per hydrophilic end; and at least about 40 percent by weight of composition of a carrier in which said polymer is dissolved or suspended.

2. A composition as claimed in claim 1 wherein said polymer is suspended in said carrier and said composition further comprises an emulsifier in amounts sufficient to suspend said polymer in said carrier.

3. A composition as claimed in claim 2 wherein said emulsifier is cationic.

4. A composition as claimed in claim 2 wherein said emulsifier is cetyltrimethyl ammonium bromide.

5. A composition as claimed in claim 2 wherein said emulsifier is a quaternary ammonium halide.

6. A composition as claimed in claim 1 wherein said ionic, non-polymeric fluoro surfactant is from about 1% to about 10% by weight of polymer.

7. A composition as claimed in claim 1 wherein said polymer includes monomeric units derived from alkyl methacrylates, styrenes,, alkyl acrylates, olefins and copolymers thereof.

8. A composition as claimed in claim 7 wherein said polymer is predominantly derived from alkyl methacrylate.

9. A composition as claimed in claim 8 wherein said copolymer contains at least about 90% monomeric units derived from lower alkyl methacrylate.

10. A composition as claimed in claim 9 wherein said polymer is a copolymer with from about 0.5 to about 10 percent by monomeric unit derived from N-methylol acrylamide.

11. A composition as claimed in claim 10 wherein said copolymer contains from about 95 to about 99.5 percent methyl methacrylate and from about 0.5 to about 5.0 percent N-methylol acrylamide by monomeric unit.

12. A composition as claimed in claim 7 wherein said polymer includes as the predominant monomer a monomer derived from a compound soluted from the group consisting of 3-3-dimethyl-1-butene, 3-methyl-1-butene, isobornylacrylate, 5-tert-butyl-2-methylstyrene, styrene, N-vinylpyrralidone, diacetone acrylanide and 3-vinyl pyridine.

13. A composition as claimed in claim 1 wherein said ionic, non-polymeric fluoro surfactant has 6–20 carbons.

14. A composition as claimed in claim 13 wherein said ionic, non-polymeric fluoro surfactant has 6–12 carbons.

15. A composition as claimed in claim 1 wherein said ionic, non-polymeric fluoro surfactant includes a radical of the formula $(CF_3)_2CFOCF_2CF_2$— or $C_nF_{2n+1}$ where $n$ = 6–12.

16. A composition as claimed in claim 15 wherein said ionic, non-polymeric surfactant is $(CF_3)_2CFOCF_2CF_2(CF_2)_n(CH_2)_mCOOM$ where $n$ is 2–12, $m$ is 0–10, M is H or alkali metal.

17. A composition as claimed in claim 15 wherein said surfactant is $$\begin{array}{l} R-CH_2CH(CH_2)_mCOOM \\ \quad\quad\quad\quad | \\ R-CH_2CH(CH_2)_mCOOM \end{array}$$

where $m$ = 0–8, M is H or alkali metal and R is either $(CF_3)_2CFOCF_2CF_2(CF_2CF_2)_n$ with $n$ = 0–5 or R is $C_nF_{2n+1}$ with $n$ = 6–12.

18. A composition as claimed in claim 15 wherein said ionic, non-polymeric fluoro surfactant is $R(CH_2)_mSO_3M$ where $m$ is 0–10, M is alkali or alkali earth metal and R is $(CF_3)_2CFOCF_2(CF_2CF_2)_n$— with $n$ = 0–5 or R is $C_nF_{2m+1}$ with $n$ = 6–12.

19. A composition as claimed in claim 15 wherein said ionic, non-polymeric fluoro surfactant is $$R(CH_2)_mOCOCH_2N^+(CH_2CH_2O)_3Cl^-$$

wherein $m$ is 0–5 and R is $(CF_3)_2CFOCF_2(CF_2CF_2)_n$ with $n$ = 0–5 or R is $C_nF_{2n+1}$ with $n$ = 6–12.

20. A composition as claimed in claim 15 wherein said ionic, non-polymeric surfactant is

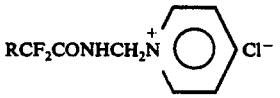

where R is $(CF_3)_2CFO(CF_2CF_2)_n$ with $n$ = 1–5 or R is $C_nF_{2n+1}$ where $n$ = 6–12.

21. A composition as claimed in claim 15 wherein said ionic, non-polymeric surfactant is $[RCH_2CH_2SC(NH_2)_2]^+I^-$ where R is $(CF_3)_2CFO(CF_2CF_2)_n$ with $n$ = 1–5 or R is $C_nF_{2n+1}$ with $n$ = 6–12.

22. A composition as claimed in claim 15 wherein said ionic, non-polymeric fluoro surfactant is selected from the group consisting of:

(a) $(CF_3)_2CFO(CF_2)_2(CH_2)_mCOOM$,
(b) $C_nF_{2n+1}(CH_2)_mCOOM$,
(c) $(CF_3)_2CFO(CF_2)_b(CH_2)_dCH(CH_2)_mCOOM$
$(CF_3)_2CFO(CF_2)_b(CH_2)_dCH(CH_2)_mCOOM$,
(d) $C_nF_{2n+1}(CH_2)_dCH(CH_2)_mCOOM$
$C_nF_{2n+1}(CH_2)_dCH(CH_2)_mCOOM$,
(e) $(CF_3)_2CFO(CF_2)_b(CH_2)_mSO_3M$, and
(f) $C_nF_{2n+1}(CH_2)_mSO_3M$ wherein $n$ is 6 to 12, M is H or alkali metal, $m$ is 0 to 10, a is 4 to 14, $b$ is 2 to 7 and $d$ is 1 to 4.

23. A textile fabric including a fiber to which the composition of claim 1 has been applied.

24. A textile fabric as claimed in claim 23 wherein said ionic, non-polymeric fluoro surfactant has a radical $(CF_3)_2CFOCF_2CF_2$— or $C_nF_{2n+1}$ where $n$ = 6–12.

25. A textile fabric as claimed in claim 23 wherein the fabric has remaining from the composition, exclusive of carrier, a solids content of about 0.25% to about 10% by weight of fabric.

26. A textile fabric as claimed in claim 25 wherein the fabric has remaining from the composition, exclusive of carrier, a solids content of about 1% to about 4% by weight of fabric.

27. A textile fabric as claimed in claim 23 wherein said fiber is nylon.

28. The textile fabric of claim 23 wherein said polymer includes predominantly methyl methacrylate monomeric units.

29. The textile fabric of claim 23 wherein said ionic, nonpolymeric fluoro surfactant is a carboxylic acid, an alkali metal salt of a carboxylic acid, a sulfonic acid, an alkali metal salt of a sulfonic acid, a quaternized N-halomethyl amide or a quaternized haloalkyl ester.

30. The textile fabric of claim 23 wherein the percent of said polymer is from about 1 to about 4 percent by weight of said fabric.

31. A process for treating a textile fabric comprising applying to the fabric a composition as claimed in claim 1.

32. A process as claimed in claim 31 wherein said process includes preparing the polymer as a suspension using an emulsifier and adding the ionic, nonpolymeric fluoro surfactant to the suspension.

33. A process as claimed in claim 32 wherein said fluoro surfactant is compatible with said ionic, nonpolymeric emulsifier.

34. A process as claimed in claim 31 wherein said fiber is nylon.

35. A process as claimed in claim 31 including diluting said composition with carrier until the composition is at least 70% carrier and then applying the composition to the fiber.

36. A process as claimed in claim 31 wherein the composition is applied in quantities sufficient to deposit from about 0.25% to about 9% polymer by weight of fabric.

37. A process as claimed in claim 36 wherein the composition is applied in quantities sufficient to deposit from about 1% to about 4% polymer by weight of fiber.

* * * * *